US006467276B2

(12) United States Patent
Chung et al.

(10) Patent No.: US 6,467,276 B2
(45) Date of Patent: Oct. 22, 2002

(54) PULSE TUBE REFRIGERATOR

(75) Inventors: Woo Suk Chung, Seongnam; Sung Tae Kim, Seoul, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/750,699

(22) Filed: Jan. 2, 2001

(65) Prior Publication Data

US 2001/0015068 A1 Aug. 23, 2001

(30) Foreign Application Priority Data

Feb. 17, 2000 (KR) ..... 7593/2000
Aug. 22, 2000 (KR) ..... 48662/2000

(51) Int. Cl.[7] ..... F25B 9/00
(52) U.S. Cl. ..... 62/6; 60/520
(58) Field of Search ..... 62/6; 60/520

(56) References Cited

U.S. PATENT DOCUMENTS

| | | | | |
|---|---|---|---|---|
| 4,394,819 A | | 7/1983 | Averill | |
| 4,642,995 A | | 2/1987 | Bachler et al. | |
| 4,739,634 A | | 4/1988 | Watanabe | |
| 4,745,761 A | | 5/1988 | Bazaj et al. | |
| 4,854,131 A | | 8/1989 | Sakitani et al. | |
| 5,090,206 A | | 2/1992 | Strasser | |
| 5,913,392 A | | 6/1999 | Eckel et al. | |
| 5,966,943 A | * | 10/1999 | Mitchell | 62/6 |
| 6,094,921 A | * | 8/2000 | Zhu et al. | 62/6 |

FOREIGN PATENT DOCUMENTS

| | | |
|---|---|---|
| DE | 3816033 | 12/1989 |
| DE | 4035166 | 4/1992 |
| EP | 111032 | 6/1984 |
| EP | WO 90 04144 | 4/1990 |
| EP | 1031728 | 8/2000 |
| JP | 59 032754 | 2/1984 |

* cited by examiner

*Primary Examiner*—Ronald Capossela
(74) *Attorney, Agent, or Firm*—Birch, Stewart, Kolasch & Birch, LLP

(57) ABSTRACT

A pulse tube refrigerator includes a compressor, an after-cooler, a regenerating unit, a pulse tube, an inertance tube, a reservoir, and a vibration absorbing unit which are structured such that vibrations during motor operation are minimized. The vibration absorbing unit is attached with the compressor and is positioned within the reservoir, and has a fixed shaft having one end attached with a housing of the compressor, a plurality of spring plates attached to another end of the fixed shaft, and a mass body attached with the spring plates.

11 Claims, 8 Drawing Sheets

PULSE TUBE REFRIGERATOR

BACKGROUND OF THE INVENTION

1. Field of the Invention

The present invention relates to a pulse tube refrigerator, and in particular, to a pulse tube refrigerator which is capable of minimizing vibration occurring during the operation, and having a simple overall structure.

2. Description of the Prior Art

In general, a pulse tube refrigerator is one type of cryogenic refrigerator having a low-vibration and high-reliability which is used for cooling small size electronic parts or super-conductors. A Stirling refrigerator and a GM refrigerator are widely used as the cryogenic refrigerator.

As depicted in FIG. 1, the conventional pulse tube refrigerator comprises a compressor 10 for compressing operating gas by generating a linear reciprocation operating force, a pulse tube 20 for releasing heat on the compressing part 21 and absorbing external heat on an expanding part 22 while the operating gas is compressed and expanded at both ends of the tube by the operation of the compressor 10, an inertance tube 30 for generating phase difference between mass flow and pressure pulsation of the operating gas fluctuated by connecting to the pulse tube 20 and at the same time achieving the heat balance, a reservoir 40 connected to the end of the inertance tube 30, a regenerating unit 50 connected between the pulse tube 20 and after-cooler 60 in order to store and release sensible heat of the operating gas passing the pulse tube 20 by being sucked and compressed at the compressor 10, and an after-cooler 60 placed between the regenerating unit 50 and compressor 10 for cooling the operating gas pushed by the compressor 10 before it reaches the regenerating unit 50.

The compressor 10 for compressing and sucking the operating gas while generating the linear reciprocation operating force comprises a sealed casing 11 having the inner area covering housings 11*b*, 11*c*, an upper housing 11*a* closely combined to the upper outer circumference of the sealed casing 11 having a cylinder unit on the center portion, a middle housing 11*b* which is placed inside of the sealed casing 11 and its upper surface is closely combined to the lower surface of the upper housing 11*a*, an elastic supporting member 15 is combined inside of it, an operating motor 12 having a piston 14 inserted into the cylinder unit 13 is fixedly installed on it, and a lower housing 11*c* which is placed inside of the sealed casing 11 and its upper surface is closely combined to the lower surface of the middle housing 11*b*, the elastic supporting member 15 is combined to it.

The operation of the conventional pulse tube refrigerator will now be described.

First, when the compressor 10 compresses and sucks the operating gas by being applied power, the operating gas flows into the pulse tube 20 after passing the after-cooler 60 and regenerating unit 50, is discharged into the inertance tube 30, repeats the reverse operation, while repeating the above operation, the phase difference is generated between the mass flow and pressure pulsation, according to this the compressing and expanding occur at the compressing part 21 and expanding part 22 of the pulse tube 20, temperature on the expanding part 22 of the pulse tube 20 lowers drastically.

The inertance tube 30 and reservoir 40 accelerate the compressing and expanding of the operating gas at the pulse tube 20, the after-cooler pre-cools the operating gas pushed from the compressor 10, and the regenerating unit 50 stores/releases the sensible heat of the operating gas reciprocating between the compressor 10 and pulse tube 20.

While repeating the above-mentioned process, the expanding part 22 of the pulse tube 20 is cooled continually, and accordingly the cryogenic refrigeration is obtained.

However, in the conventional pulse tube refrigerator, vibration occurs while the operating gas is compressed by the piston receiving the linear reciprocating motion of the operating motor installed in the compressor, and it causes the vibration noise.

In addition, because the reservoir constructed as the additional part is connected to the inertance tube having a certain length, the overall size of the pulse tube refrigerator is big, lots of manufacturing costs are required, it is difficult to transfer, and it requires lots of installation area.

SUMMARY OF THE INVENTION

The object of the present invention is to provide a pulse tube refrigerator which has a simple overall structure.

Another object of the present invention is to provide the pulse tube refrigerator having a vibration absorbing unit which efficiently reduces vibration occurring while compressing operating gas.

Another object of the present invention is to provide the pulse tube refrigerator having a combining structure of a sealing member which improves the efficiency of the vibration absorbing unit.

In order to achieve the objects, the pulse tube refrigerator according to the present invention comprises a compressor having a sealed casing with a cylinder and an opening at one end thereof, a motor mounted in the sealed casing, and a piston operatively attached with the motor to compress and expand an operating gas via the opening, an after-cooler connected with the compressor in order to cool the operating gas discharged from the compressor, a regenerating unit connected with the after-cooler in order to store and release latent heat of the operating gas reciprocating between the compressor and reservoir formed at an outer surface of the sealed casing and a cover integrally attached to the sealed casing, a pulse tube connected with the regenerating unit, the pulse tube having a cryogenic portion formed thereon, an inertance tube connected with the pulse tube in order to accelerate a formation of the cryogenic portion and connected with the cover, and a vibration absorbing unit which is placed inside of the reservoir and is fixedly attached to the sealed casing in order to reduce the vibration occurring due to the operation of the motor.

In addition, in order to achieve the above-mentioned objects, the pulse tube refrigerator according to the present invention comprises a compressor having a sealed casing with a cylinder and an opening at one end thereof, a motor mounted in the sealed casing, and a piston operatively attached with the motor to compress and expand an operating gas via the opening, an after-cooler connected with the compressor in order to cool the operating gas discharged from the compressor, a regenerating unit connected with the after-cooler in order to store and release latent heat of the operating gas reciprocating between the compressor and a reservoir formed at an outer surface of the sealed casing a a cover attached to the sealed casing, a pulse tube connected with the regenerating unit, the pulse tube having a cryogenic portion formed thereon, an inertance tube connected with the pulse tube in order to accelerate a formation of the cryogenic portion and connected with the cover, a sealing member which is placed between the cover and casing in order to prevent leakage of the operating gas, and a vibration absorbing unit placed inside of the reservoir and fixedly attached to the sealing member in order to reduce the vibration occurring due to the operation of the motor.

DETAILED DESCRIPTION OF THE PREFERRED EMBODIMENT

Hereinafter, the embodiments of a pulse tube refrigerator according to the present invention will now be described with reference to the accompanying drawings.

Figure 1:
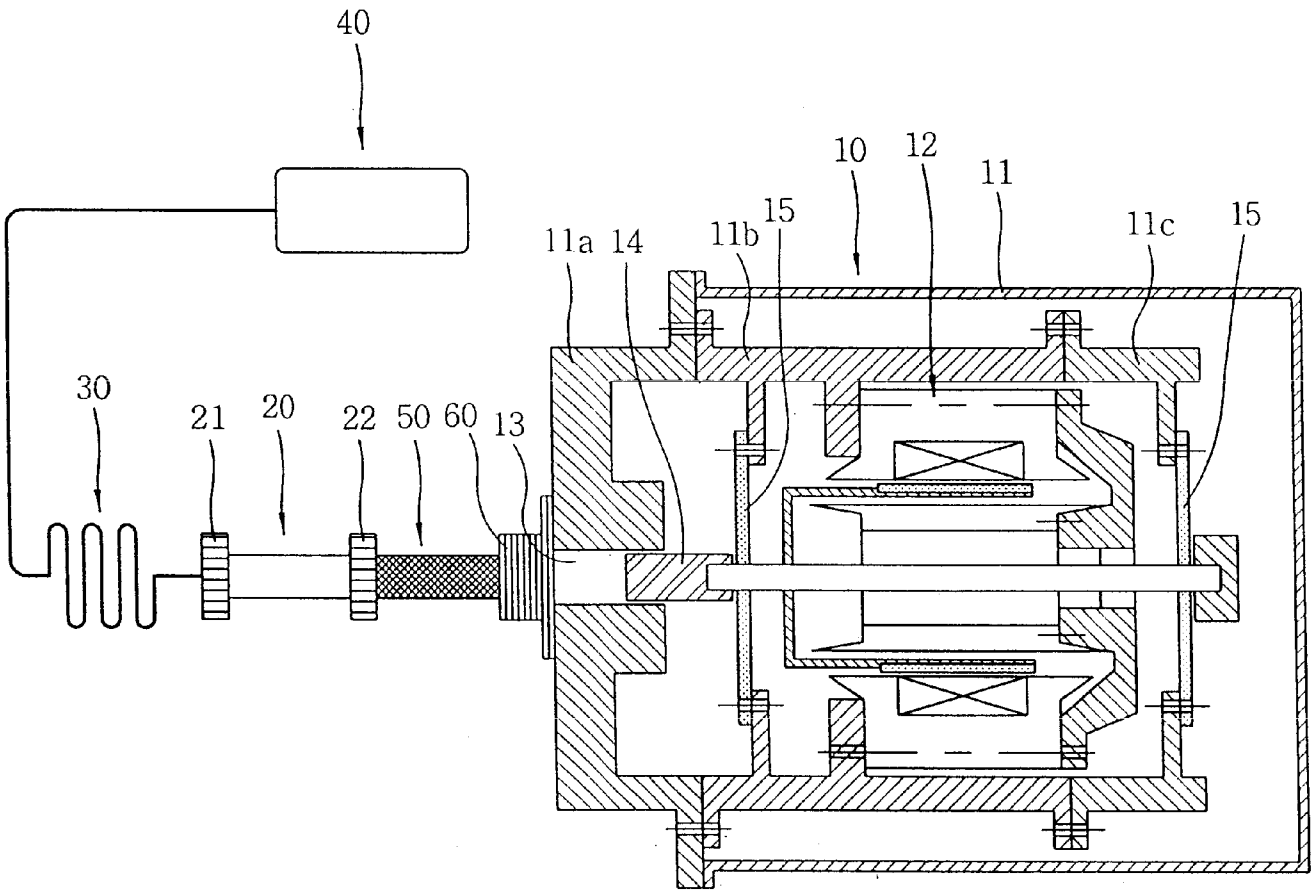
FIG. 1 CONVENTIONAL ART
FIG. 1 is a schematic sectional view illustrating the conventional pulse tube refrigerator.
Figure 2:
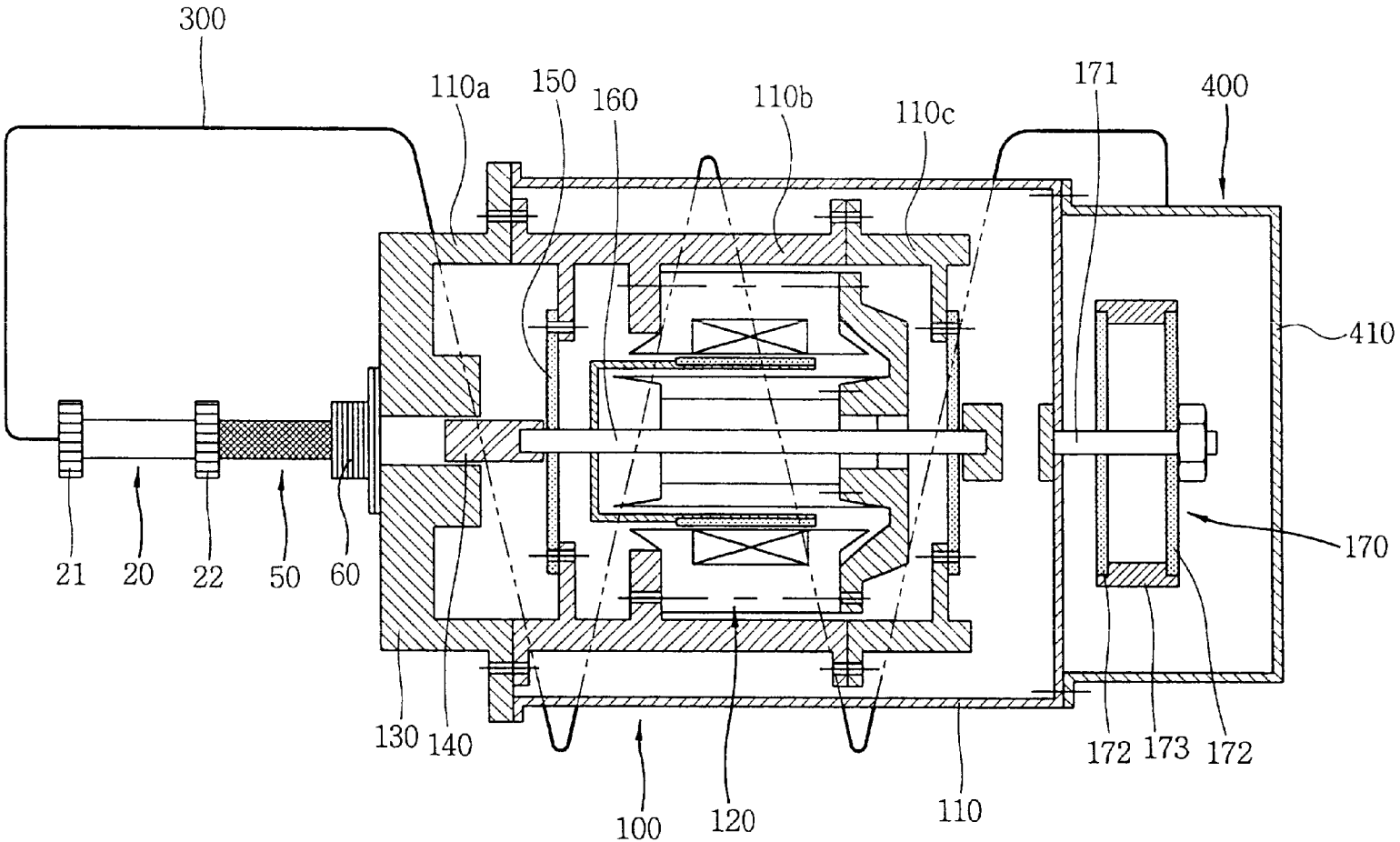
FIG. 2 is a schematic sectional view illustrating a pulse tube refrigerator in accordance with the first embodiment of the present invention.

As depicted in FIG. 2, the pulse tube refrigerator according to the first embodiment of the present invention comprises a compressor 100 for compressing and sucking operating gas by generating a linear reciprocation operating force, a pulse tube 20 for releasing heat on the compressing part 21 by the mass flow of the compressed and sucked operating gas on the compressor 200 and absorbing external heat on an expanding part 22 while the operating gas is separately compressed and expanded at both ends of the pulse tube 20 by the operation of the compressor 100, an inertance tube 300 for generating phase difference between mass flow and pressure pulsation of the operating gas fluctuated by connecting to the pulse tube 20 and at the same time achieving the heat balance, a reservoir 400 connected to the end of the inertance tube 300, and a regenerating unit 50 connected between the pulse tube 20 and an after-cooler 60 in order to release sensible heat of the operating gas passing the pulse tube 20 by being sucked and compressed at the compressor 100, the after-cooler 60 being utilized for cooling the operating gas pushed by the compressor 100 before it reaches the regenerating unit 50.

The compressor 100 comprises a sealed casing 110 having a cylinder shape including inner area covering housings 110*b*, 110*c*, an upper housing 110*a* closely combined to the upper outer circumference of the sealed casing 110 having a cylinder unit on the center portion, the middle housing 110*b* which is placed inside of the sealed casing 110 and its upper surface is closely combined to the lower surface of the upper housing 110*a*, an elastic supporting member 150 is combined inside of it, an operating motor 120 having an operating shaft 160 combined to a piston 140 inserted into the cylinder unit 130 is fixedly installed on it, and the lower housing 110*c* which is placed inside of the sealed casing 110 and its upper surface is closely combined to the lower surface of the middle housing 110*b*, the elastic supporting member 150 is combined to it.

The reservoir 400 having a predetermined sealed area is combined as one body to the outer bottom surface of the sealed casing 110 of the compressor 100.

The reservoir 400 is formed by combining the cover 410 having a cup shape to the lower side surface of the sealed casing 110 so as to be formed on the lower side surface of the sealed casing 110 of the compressor 100.

In addition, in the other embodiment of the reservoir 400, the sealed casing 110 is formed longer, and a predetermined sealed area can be formed by blocking the inner side of the sealed casing 110.

The sealed casing 110 and reservoir 400 can be combined by welding, or using bolts, nuts, pins and rivets, etc.

The inertance tube 300 is formed so as to coil around the outer circumference of the compressor 100 and reservoir 400 formed as one-body in order to minimize installation area of the pulse tube refrigerator. Herein, the inertance tube 300 coils around them as a spiral shape.

The vibration absorbing unit 170 for reducing the vibration occurring by the operation of the operating motor 120 is combined to the center lower side surface of the sealed casing 110 so as to be placed inside of the reservoir 400.

The vibration absorbing unit 170 comprises a fixed shaft 171 fixedly attached to the sealed casing 110 so as to be placed on the same line of the vibration direction of the operating motor 120, a plurality of plate springs 172 attached to the end of the fixed shaft 171, and a mass body 173 fixedly secured between the plate springs 172.

Hereinafter, the operation effect of the pulse tube refrigerator according to the first embodiment of the present invention will now be described.

When the power is applied to the operating motor 120 installed inside of the compressor 100, the operating motor 120 performs the linear reciprocating motion. The operating force is transmitted to the piston 140, and the piston 140 performs the linear reciprocating motion inside of the cylinder unit 130 in order to compress and sucks the operating gas. The vibration occurs during the motion and is transmitted to the sealed casing 110.

Figure 3:
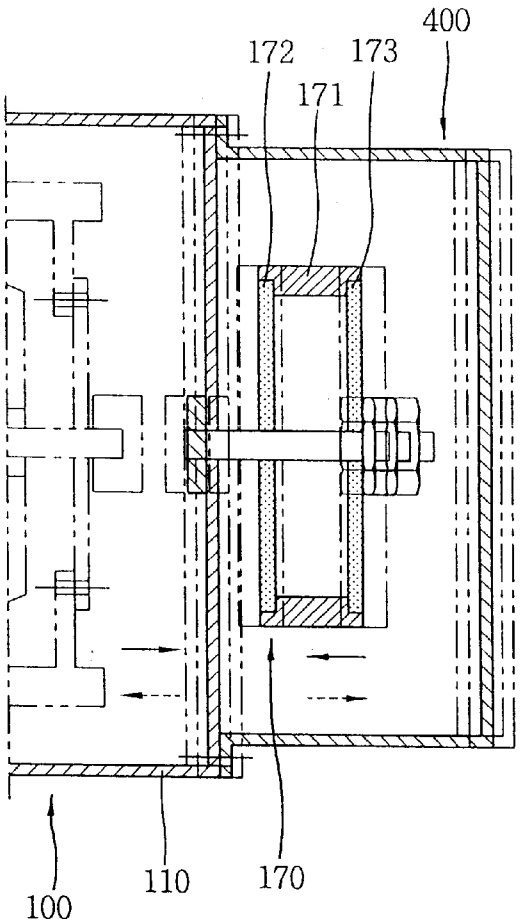
FIG. 3 is a partial sectional view illustrating the operation state of the pulse tube refrigerator in accordance with the first embodiment of the present invention.

Herein, as depicted in FIG. 3, the vibration transmitted to the sealed casing 110 is transmitted to the vibration absorbing unit 170 installed inside of the sealed casing 110. The vibration of the vibration absorbing unit 170 has a second mode opposing the vibration mode occurring from the sealed casing 110, and the vibration of the sealed casing 110 is reduced. The vibration occurring during the operating can be reduced, and the vibration noise due to the vibration can be reduced also, and quietness in the operation can be improved.

In addition, in the pulse tube refrigerator according to the first embodiment of the present invention, the reservoir 400 provided with the vibration absorbing unit 170 performs the same function as the conventional reservoir 40, and is combined to the lower side surface of the sealed casing 110.

The inertance tube 300 is formed so as to coil around the outer circumference of the sealed casing and reservoir formed as one body. Accordingly the overall size of the pulse tube refrigerator can be reduced, the transferring of the pulse tube refrigerator is easy, and the required installation area can be reduced.

Hereinafter, the pulse tube refrigerator according to the second embodiment of the present invention will now be described in detail.

Figure 4:
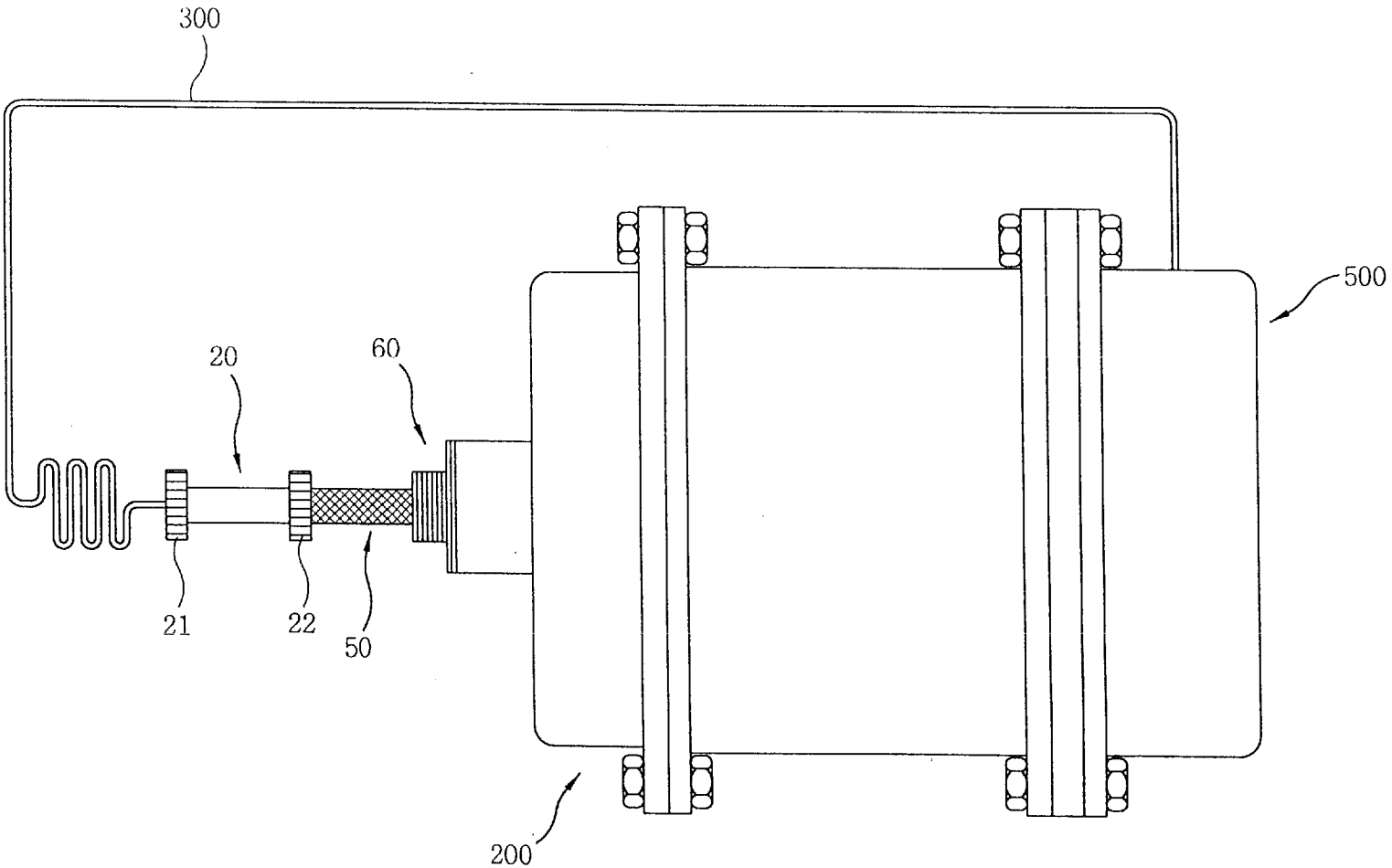
FIG. 4 is a schematic front view illustrating a pulse tube refrigerator in accordance with the second embodiment of the present invention.
Figure 5:
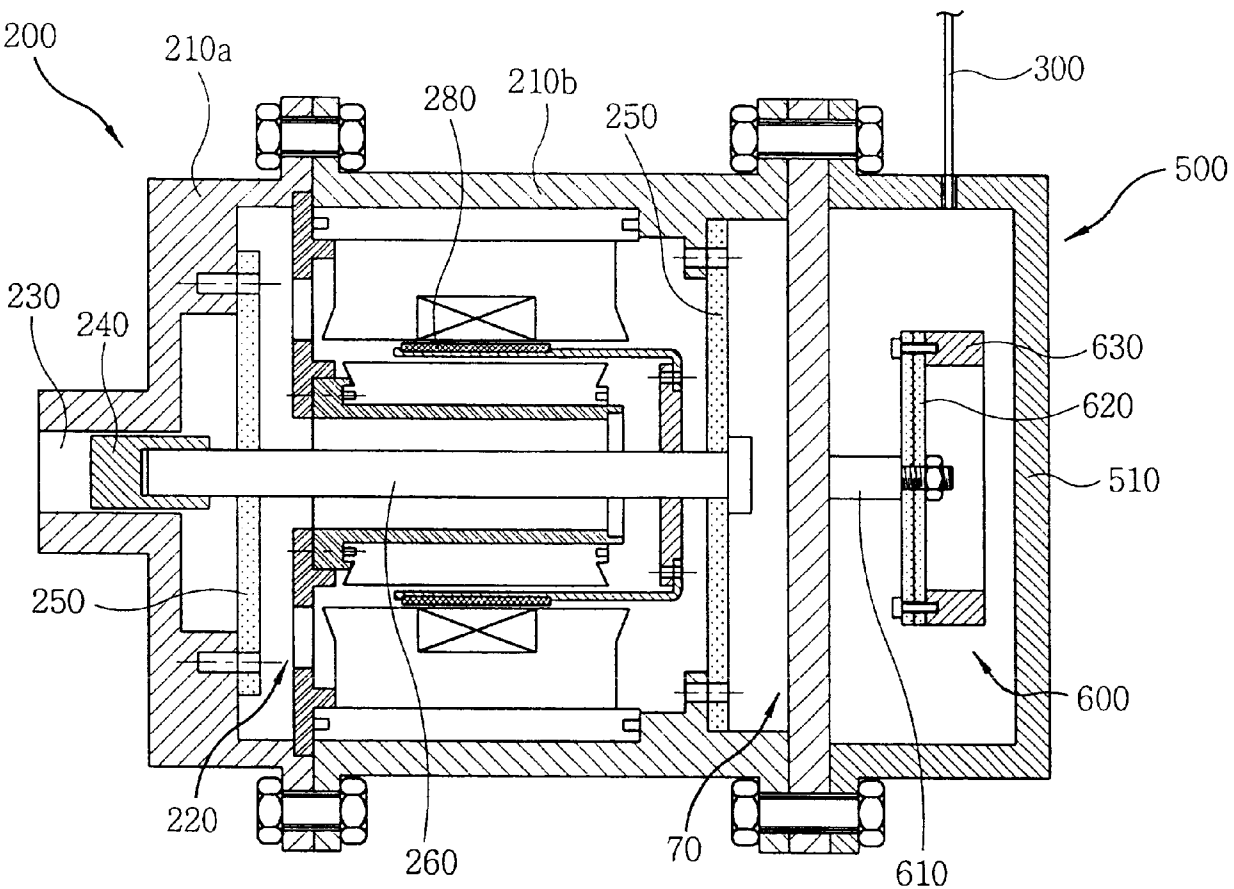
FIG. 5 is a sectional view illustrating a compressor of the pulse tube refrigerator of FIG. 4 in accordance with the second embodiment of the present invention.

The construction of the pulse tube refrigerator according to the second embodiment of the present invention will now be described with reference to accompanying FIGS. 4 and 5. The pulse tube refrigerator according to the second embodiment of the present invention comprises a compressor 200 for compressing and sucking the operating gas by generating the linear reciprocation operating force, a pulse tube 20 for releasing the heat on the compressing part 21 by the mass flow of the compressed/sucked operating gas on the compressor 200 and phase difference of the pressure pulsation and absorbing the heat on the expanding part 22, an inertance tube 300 for accelerating the mass flow and pressure pulsation on the pulse tube 20 and at the same time achieving the heat balance, a reservoir 500 formed on the lower end of the compressor 200 as one body, a regenerating unit 50 connected between the pulse tube 20 and compressor 200 in order to release sensible heat of the operating gas passing the pulse tube 20 by being sucked and compressed at the compressor 200, and an after-cooler 60 for cooling the operating gas pushed by the compressor 200.

The compressor 200 comprises a cylinder unit 230 on the side, an upper housing 210*a* having a fixedly installed elastic supporting member 250, and the middle housing 210*b* having various construction parts.

Hereinafter, the construction of the middle housing 210*b* will now be described in detail.

The middle housing 210*b* comprises the operating motor 220 connected between the operator 280 of the operating motor 220 and piston 240 with the operating shaft 260 in order to transmit the linear reciprocation operating force of the operating motor 220 to the piston 240 inserted into the cylinder unit 230, and the elastic supporting member 250 connected to the operating shaft 220 in order to guide the linear motion of the piston 240.

A flange portion having the through hole is formed on the lower circumference of the middle housing 210*b*, a through hole corresponding to the through hole formed on the flange portion is formed on the outer circumference of each of a cup-shaped cover 510 and a circular plate-type sealing member 70. The middle housing 210*b*, sealing member 70, and cover 510 are fixedly combined by a predetermined combining member, and the reservoir 500 is formed by the combination.

The side of the inertance tube 300 is connected with the side of the cover 510.

In addition, the inertance tube 300 can be formed so as to coil around the outer circumference of the upper housing 210*a* and middle housing 210*b* of the compressor 200 as the spiral shape in order to minimize the installation space, and it connects the pulse tube 20 to the reservoir 500.

The combination of the upper housing 210*a*, middle housing 210*b*, sealing member 70 and cover are fixedly combined by welding, or using bolts, nuts, pins and rivets, etc.

The elastic supporting member 250 stores the linear reciprocating motion of the operating motor 220 as elastic energy, converts the stored elastic energy into the linear motion, induces a resonance motion of the piston 240, and guides the linear reciprocating motion of the piston 240 combined to the operating shaft 260.

Meanwhile, the motion of the moving mass constructed with the operator 280 of the operating motor 220, operating shaft 260, and piston 240 performing the linear reciprocating motion in the operation of the compressor 200 causes the axial direction vibration, and a vibration absorbing unit 600 is formed inside of the reservoir 500 in order to absorb and reduce the axial direction vibration.

A fixed shaft 610 is attached to the sealing member 70 in order to coincide with the center line of the operating shaft 260 of the operating motor 220, a plurality of plate springs 620 are attached to the fixed shaft 610, and a mass body 630 having a certain weight is attached to the plate springs 620.

When the vibration occurs by the operation of the compressor 200, the excitation frequency of the vibration absorbing unit 600 coincides with the inherent frequency of the plate springs 620 and mass body 630, the vibration occurring on the compressor 200 is absorbed by the plate springs 620 and mass body 630, and the plate springs 620 and mass body 630 vibrate.

Herein, it is advisable to coincide the axial direction vibration center of the moving mass with the vibration center of the vibration absorbing unit 600 for absorbing the vibration in order to improve the absorbing efficiency of the vibration absorbing unit 600.

Hereinafter, the method for coinciding the axial direction vibration center of the moving mass with the vibration center of the vibration absorbing unit 600 will now be described in detail with reference to the accompanying drawings.

Figure 6:
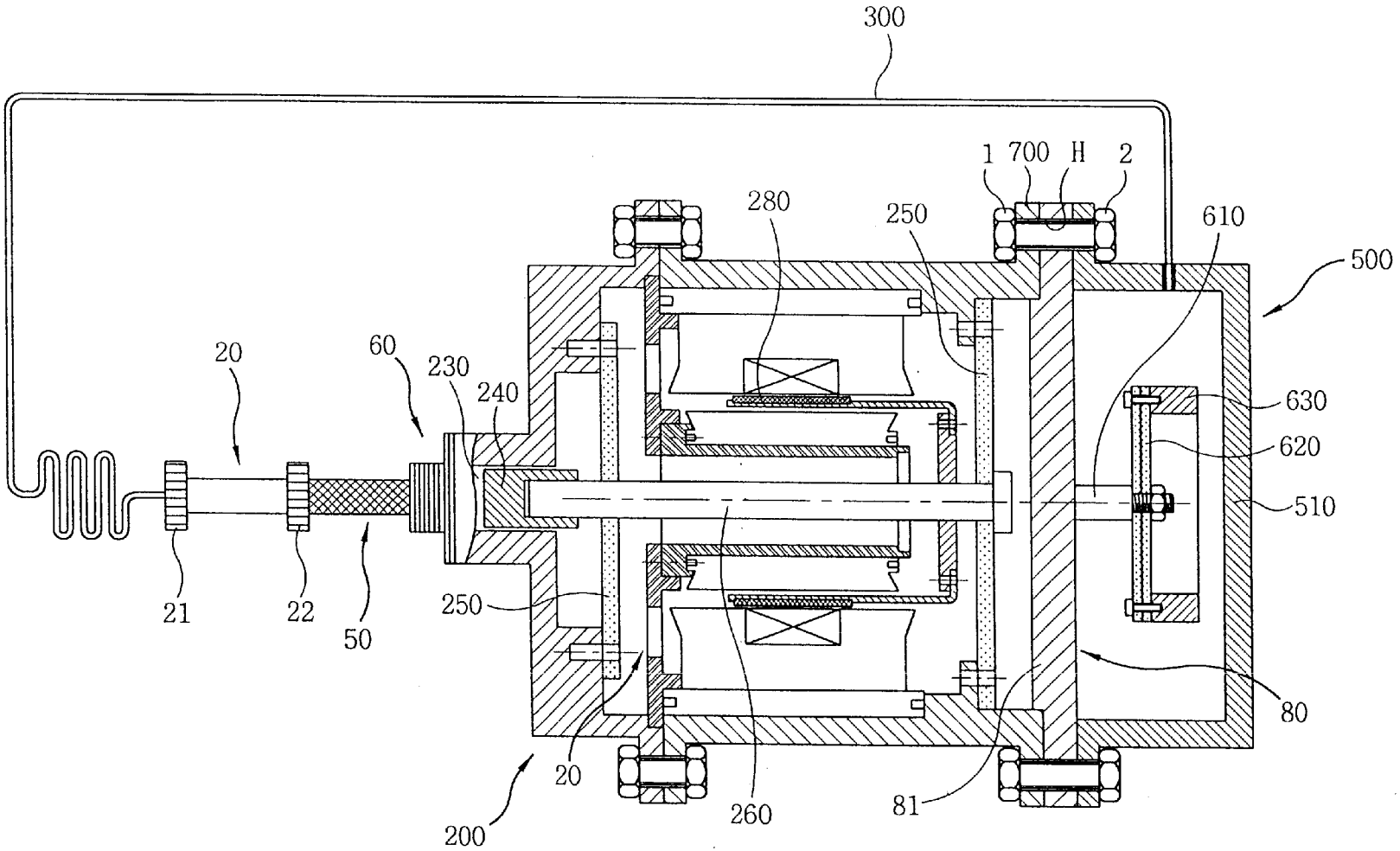
FIG. 6 is a partial sectional view illustrating a sealing member combination according to the embodiment of the present invention for constructing the compressor in accordance with the second embodiment of the present invention.

As depicted in FIG. 6, a combining part 81 is protrusively formed on the upper surface of a position setting type sealing plate 80 having the disk shape which is attached to the inner circumference of the middle housing 210*b*.

The fixed shaft 610 having a predetermined length is attached to the center of the sealing plate 80 on a side opposite to the side surface of the combining part 81. The position setting type sealing plate 80 is inserted and secured to the lower portion of the middle housing 210*b* in order to locate the combining part 81 at the inner circumference of the middle housing 210*b*.

Herein, the center of the operating shaft 260 placed inside of the housing 210*b* coincides with the center of the fixed shaft 610, and the position setting type sealing plate 80 seals the middle housing 210*b*.

The position setting type sealing plate 80 is fixedly combined to the middle housing 210*b* by a plurality of bolts 1 inserted into a plurality of through holes H formed on the flange portion 700 extended-formed on the end of the middle housing 210*b* and the position setting type sealing plate 80.

The plurality of plate springs 620 are fixedly attached to the end of the fixed shaft 610, and the mass body 630 having a predetermined weight is fixedly secured to the plate springs 620. The cover 510 having the cup shape is fixedly formed on the position setting type sealing plate 80 in order to cover the plate springs 620 and the mass body 630. The reservoir 500 having a predetermined sealed area is constructed by the position setting type sealing plate 80 and cover 510, and the side of the inertance tube 300 is connected to the side of the cover 510.

Figure 7:
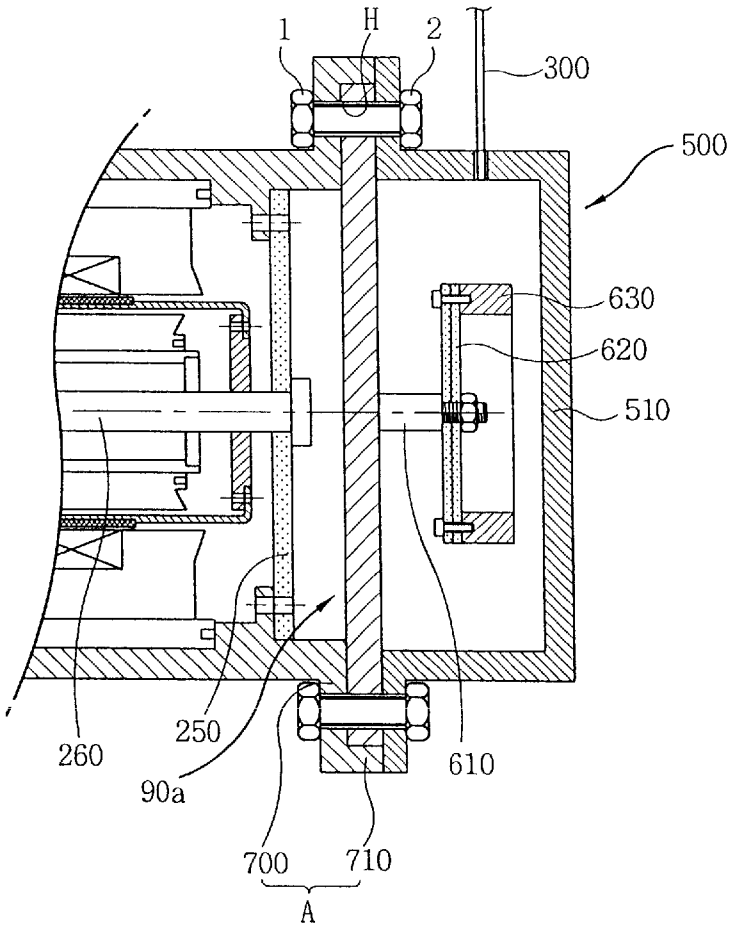
FIG. 7 is a partial sectional view illustrating the sealing member combination according to the other embodiment of the present invention for constructing the compressor in accordance with the second embodiment of the present invention.

As depicted in FIG. 7, a position setting portion A is formed on the outer circumference of the middle housing

210*b*, and a sealing plate 90*a* secured to the fixed shaft 610 is secured to the middle housing 210*b* in order to set the position by the position setting portion A.

The position setting portion A comprises the flange portion 700 extended-formed on the lower end of the middle housing 210*b* so as to correspond to the outer diameter of the sealing plate 90*a*, and a position setting protrusion portion 710, which is extended-bent downwardly from the end of the flange portion 700.

The sealing plate 90*a* is inserted into a groove formed by the flange portion 700 and the position setting protrusion portion 710, and accordingly, the center of the operating shaft 260 placed on the middle housing 210*b* coincides with the center of the fixed shaft 610 attached to the sealing plate 90*a*, and the middle housing 210*b* is sealed.

A plurality of through holes H are formed on the outer circumference of the flange portion 700 of the middle housing 210*b* and outer circumference of the sealing plate 90*a* in order to secure the sealing plate 90*a* to the middle housing 210*b*, and the sealing plate 90*a* is attached to the middle housing 210 by inserting and fastening a plurality of bolts 1 into the through holes H and securing them with nuts 2.

The plurality of plate springs 620 are fixedly attached to the end portion of the fixed shaft 610, and the mass body 630 having a predetermined weight is fixedly attached to the plate springs. The cover 510 having the cup shape is fixedly attached to the sealing plate 90*a* so as to cover the vibration absorbing unit 600. The reservoir 500 is constructed by the sealing plate 90*a* and cover 510, and the side of the inertance tube 300 is connected with the side of the cover 510.

Figure 8:
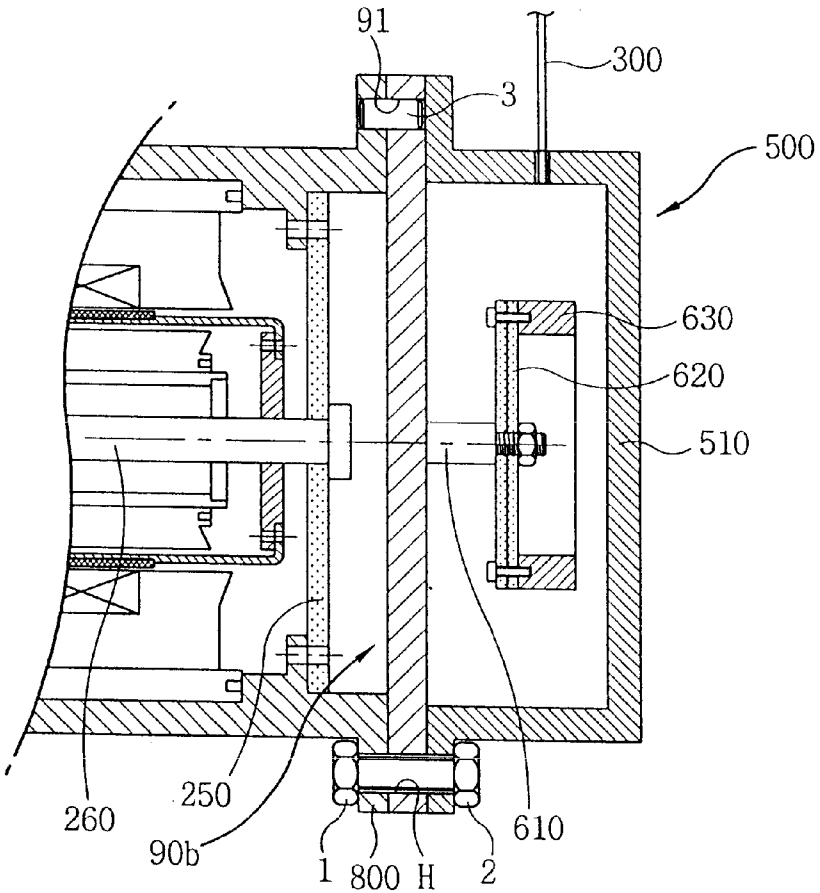
FIG. 8 is a partial sectional view illustrating the sealing member combination according to the another embodiment of the present invention for constructing the compressor in accordance with the second embodiment of the present invention.

As depicted in FIG. 8, a plurality of position setting pins 3 are fixedly secured to the outer circumference of a flange portion 800 of the middle housing 210*b*.

A plurality of pin holes 91 where the plurality of the position setting pins 3 are inserted are formed on the outer circumference of the sealing plate 90*b*, the fixed shaft 610 is attached to the lower center portion of the sealing plate 90*b*, and is attached to the flange portion of the middle housing 210*b*.

The sealing plate 90*b* seals the middle housing 210*b* by coinciding the center of the operating shaft 260 with the center of the fixed shaft 610 by inserting the plurality of the position setting pins 3 into the plurality of the pin holes 91.

The plurality of the position setting pins 3 are fixedly attached to the flange portion 800 extended-formed on the end portion of the middle housing 210*b*, and the plurality of the pin holes 91 are formed on the outer circumference of the sealing plate 90*b*.

The middle housing 210*b* is secured to the sealing plate 90*b* by forming the plurality of through holes H on the edge of the flange portion of the middle housing 210*b* and sealing plate 90*b*, and inserting the plurality of bolts 1 inserted into the through holes H and securing them with the nuts 2.

The plurality of plate springs 620 are fixedly formed on the end portion of the fixed shaft 610, and the mass body 630 having a certain weight is fixedly attached to the plurality of plate springs 620. The cover 510 having the cup shape is fixedly attached to the sealing plate 90*b* so as to cover the vibration absorbing unit 600. The reservoir 500 having a predetermined sealed area is constructed by the sealing plate 90*b* and cover 510, and the side of the cover 510 is connected to the side of the inertance tube 300.

In addition, the plurality of the pin holes are formed on the flange portion 800 of the middle housing 210*b*, the plurality of the position setting pins 3 corresponding to the plurality of the pin holes are fixedly attached to the sealing plate 90*b*, and according to this, the center of the fixed shaft 610 fixedly combined to the sealing plate 90*b* coincides with the center of the operating shaft 260 placed inside of the middle housing 210*b*.

Hereinafter, the operation effect of the pulse tube refrigerator in accordance with the second embodiment of the present invention will now be described.

The pulse tube refrigerator in accordance with the present invention is capable of preventing an eccentric vibration of the plate springs and mass body about the axial directional vibration of the compressor by performing the axial directional vibration in the operation of the compressor on the same line with the axial direction vibration of the plate springs and mass body of the vibration absorbing unit for absorbing the vibration.

Accordingly, the pulse tube refrigerator in accordance with the present invention is capable of improving the quietness in the operation by reducing the vibration noise of the overall system by stabilizing the vibration of the plate springs and mass body. And, the pulse tube refrigerator in accordance with the present invention can be transported easily and requires a smaller installation area by reducing the size of the pulse tube refrigerator by placing the inertance tube at a proper position and forming the reservoir so as to be one-bodied to the housing.

What is claimed is:

1. A pulse tube refrigerator, comprising:

a compressor having a sealed casing with a cylinder and an opening at one end thereof, a motor mounted in the sealed casing, and a piston operatively attached with the motor to compress and expand an operating gas via the opening;

an after-cooler connected with the compressor in order to cool the operating gas discharged from the compressor;

a regenerating unit connected with the after-cooler in order to store and release latent heat of the operating gas reciprocating between the compressor and a reservoir formed at an outer surface of the sealed casing and a cover integrally attached to the sealed casing;

a pulse tube connected with the regenerating unit, the pulse tube having a cryogenic portion formed thereon;

an inertance tube connected with the pulse tube in order to accelerate a forming of the cryogenic portion and connected with the cover; and a vibration absorbing unit which is placed inside of the reservoir and is fixedly attached to the sealed casing in order to reduce vibration occurring due to the operation of the motor.

2. The pulse tube refrigerator according to claim 1, wherein the inertance tube coils around an outer circumference of the compressor and the reservoir.

3. The pulse tube refrigerator according to claim 1, wherein the vibration absorbing unit comprises:

a fixed shaft combined to the center of the lower surface of the sealed casing;

a plurality of plate spring combined to an outer circumference of the fixed shaft in order to generate a frequency of vibration coincided with a frequency of vibration of the motor; and a mass body fixedly combined to the plurality of plate springs.

4. A pulse tube refrigerator, comprising:

a compressor having a sealed case with a cylinder and an opening at one end thereof, a motor mounted in the sealed casing, and a piston operatively attached with the motor to compress and expand an operating gas via the opening;

an after-cooler connected with the compressor in order to cool the operating gas discharged from the compressor;

a regenerating unit connected with the after-cooler in order to store and release latent heat of the operating gas reciprocating between the compressor and a reservoir formed at an outer surface of the sealed casing and a cover attached to the sealed casing;

a pulse tube connected with the regenerating unit, the pulse tube having a cryogenic portion formed thereon;

an inertance tube connected with the pulse tube in order to accelerate a forming of the cryogenic portion and connected with the cover;

a sealing member which is placed between the cover and the casing in order to prevent leakage of the operating gas; and a vibration absorbing unit placed inside of the reservoir in order to reduce vibration occurring due to the operation of the motor.

5. The pulse tube refrigerator according to claim 4, wherein the inertance tube coils around an outer circumference of the compressor and the reservoir.

6. The pulse tube refrigerator according to claim 4, wherein the vibration absorbing unit comprises:

a fixed shaft combined to the center of the lower surface of the sealing member;

a plurality of plate springs combined to the fixed shaft in order to generate a frequency of vibration coincided with a frequency of vibration of the motor; and a mass body fixedly combined to the plurality of plate springs.

7. The pulse tube refrigerator according to claim 6, wherein a protrusive combining portion is formed on an upper portion of the sealing member so as to be inserted and combined to the inner circumference of the casing in order to coincide a center line of an operating shaft of the motor with a center line of the fixed shaft.

8. The pulse tube refrigerator according to claim 6, wherein the casing comprises a flange portion radially extended therefrom, and a position setting protrusion portion downwardly extended from the outline of the flange portion in order to coincide an operating shaft of the motor with a center line of the fixed shaft, an outer circumference of the sealing member is extended so as to correspond to an inner circumference of an inner groove of the position setting protrusion portion, and the cover is extended so as to correspond to an outer circumference of the flange portion.

9. The pulse tube refrigerator according to claim 8, wherein a position setting pin is fixedly combined to an outer circumference of the flange portion in order to coincide an operating shaft of the operating motor with the center line of the fixed shaft, and a pin hole is formed on an outer circumference of the sealing member so as to correspond to the position setting pin.

10. The pulse tube refrigerator according to claim 9, wherein the position setting pin is fixedly combined to the outer circumference of the sealing member in order to coincide the operating shaft of the motor with the center line of the fixed shaft, and the pin hole is formed on the outer circumference of the flange portion.

11. The pulse tube refrigerator according to claim 4, wherein the casing, sealing member, and cover are sealed, combined with a combining member by forming a through hole on an outer circumference of the sealing member, and formed with a through hole on a flange portion of the lower circumference of the casing combined to the sealing member and upper outer circumference of the cover combined to the sealing member so as to correspond to the through hole formed on the sealing member.

* * * * *